US011668164B2

(12) United States Patent
Larsen

(10) Patent No.: US 11,668,164 B2
(45) Date of Patent: Jun. 6, 2023

(54) SELF-DEFLECTING MULTILATERAL JUNCTION

(71) Applicant: Halliburton Energy Services, Inc., Houston, TX (US)

(72) Inventor: Lars Petter Larsen, Hafrsfjord (NO)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/353,968

(22) Filed: Jun. 22, 2021

(65) Prior Publication Data

US 2021/0404294 A1 Dec. 30, 2021

Related U.S. Application Data

(60) Provisional application No. 63/045,612, filed on Jun. 29, 2020.

(51) Int. Cl.

| | |
|---|---|
| ***E21B 41/00*** | (2006.01) |
| ***E21B 7/06*** | (2006.01) |
| ***E21B 43/30*** | (2006.01) |
| *E21B 17/14* | (2006.01) |

(52) U.S. Cl.

CPC ..... *E21B 41/0042* (2013.01); *E21B 7/061* (2013.01); *E21B 43/305* (2013.01); *E21B 17/14* (2013.01)

(58) Field of Classification Search

CPC ..... E21B 7/061; E21B 33/10; E21B 41/0035; E21B 41/0042

See application file for complete search history.

(56) References Cited

U.S. PATENT DOCUMENTS

| | | | | |
|---|---|---|---|---|
| 6,019,173 | A | 2/2000 | Saurer et al. | |
| 6,209,644 | B1 * | 4/2001 | Brunet | E21B 41/0042 166/117.6 |
| 2004/0182578 | A1 | 9/2004 | Steele et al. | |
| 2009/0255664 | A1 * | 10/2009 | Hart | E21B 41/0042 166/117.6 |
| 2016/0145956 | A1 | 5/2016 | Dahl et al. | |
| 2019/0040719 | A1 * | 2/2019 | Rodriguez | E21B 41/0042 |

FOREIGN PATENT DOCUMENTS

| | | | |
|---|---|---|---|
| EP | 1246994 | B1 | 7/2006 |
| WO | 2010135376 | A1 | 11/2010 |

* cited by examiner

*Primary Examiner* — Robert E Fuller
*Assistant Examiner* — Lamia Quaim
(74) *Attorney, Agent, or Firm* — Scott Richardson; Parker Justiss, P.C.

(57) ABSTRACT

Provided is a self-deflecting multilateral junction, a method, and a well system. The self-deflecting multilateral junction, in one aspect, includes a deflection device having an uphole end and a downhole end, the deflection device including a main tubular, a first flow path off the main tubular and operable to couple to a wellbore, a second flow path off the main tubular and operable to couple to a lateral wellbore, the second flow path having a lateral seal bore, and a deflecting ramp. The self-deflecting multilateral junction, according to this aspect, further includes a lateral stinger positioned within the main tubular and releasably coupled to the deflection device, the lateral stinger including a nose end configured to extend into the second flow path, a valve member, and a lateral seal for engaging the lateral seal bore.

21 Claims, 16 Drawing Sheets

SELF-DEFLECTING MULTILATERAL JUNCTION

BACKGROUND

The unconventional market is very competitive. The market is trending towards longer horizontal wells to increase reservoir contact. Multilateral wellbores offer an alternative approach to maximize reservoir contact. Multilateral wellbores include one or more lateral wellbores extending from another wellbore, such as a main wellbore.

BRIEF DESCRIPTION

Reference is now made to the following descriptions taken in conjunction with the accompanying drawings, in which.

DETAILED DESCRIPTION

Figure 1:
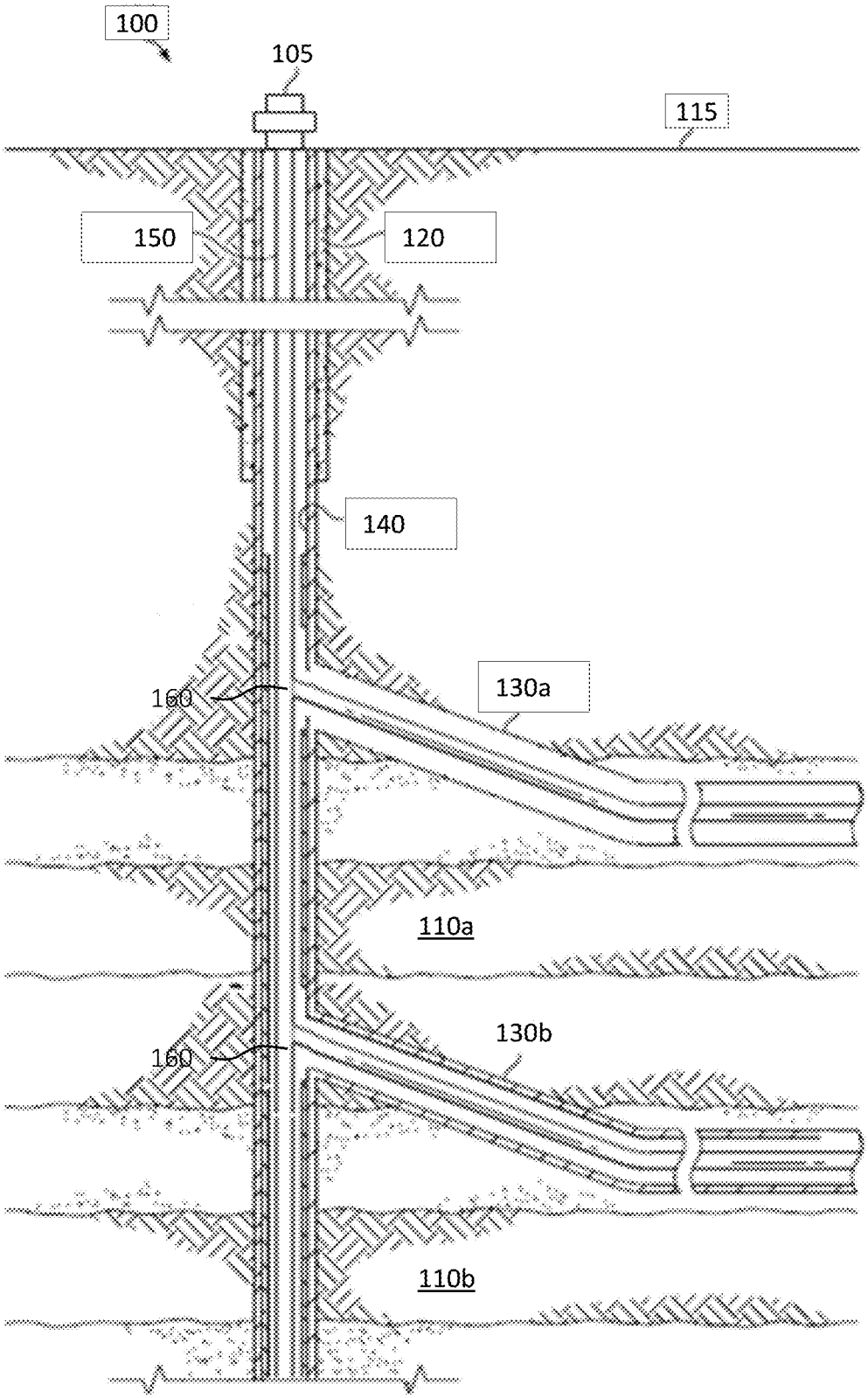
FIG. 1 illustrates a schematic view of a multilateral well system according to one or more embodiments disclosed herein.

A subterranean formation containing oil and/or gas hydrocarbons may be referred to as a reservoir, in which a reservoir may be located on-shore or off-shore. Reservoirs are typically located in the range of a few hundred feet (shallow reservoirs) to tens of thousands of feet (ultra-deep reservoirs). To produce oil, gas, or other fluids from the reservoir, a well is drilled into a reservoir or adjacent to a reservoir.

A well can include, without limitation, an oil, gas, or water production well, or an injection well. As used herein, a "well" includes at least one wellbore having a wellbore wall. A wellbore can include vertical, inclined, and horizontal portions, and it can be straight, curved, or branched. As used herein, the term "wellbore" includes any cased, and any uncased (e.g., open hole) portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet of the wellbore. As used herein, "into a well" means and includes into any portion of the well, including into the wellbore or into the near-wellbore region via the wellbore.

While a main wellbore may in some instances be formed in a substantially vertical orientation relative to a surface of the well, and while the lateral wellbore may in some instances be formed in a substantially horizontal orientation relative to the surface of the well, reference herein to either the main wellbore or the lateral wellbore is not meant to imply any particular orientation, and the orientation of each of these wellbores may include portions that are vertical, non-vertical, horizontal or non-horizontal. Further, the term "uphole" refers a direction that is towards the surface of the well, while the term "downhole" refers a direction that is away from the surface of the well.

A multilateral well (e.g., Multilateral Technology, also referred to as MLT) is a well where additional branches are added to a single wellbore. Multilateral wells are used for both new and re-entry wells and offer the ability to increase the reservoir exposure and drain the reservoirs more efficiently. As compared to two single wells, multilateral wells have higher reservoir exposure, high production rate at low drawdown, cost and time savings compared to multiple separate wells, reduced slot requirement, and earlier production, among other advantages.

Provided, in one embodiment, is a self-deflecting multilateral junction. The self-deflecting multilateral junction, in at least one embodiment, provides a "single trip", pressure tight MLT junction with lateral and main bore access. For example, no separate deflector run is required in certain embodiments. The self-deflecting multilateral junction provides internal diameter (ID) access to the second lateral wellbore, and potentially also the first wellbore (e.g., first main wellbore), depending on size. The self-deflecting multilateral junction may also be implemented into and combined with multiple existing multilateral technology systems. For example, the self-deflecting multilateral junction may be used with the Halliburton FlexRite® (pre-milled aluminum exit, high side) (cased hole) system, wherein it is run with whipstock milling prior to running the deflecting junction, but no separate deflector run is required. Additionally, the self-deflecting multilateral junction may be used with the Halliburton Reflex Rite® system, wherein it is run with anchor (packer/expandable) and whipstock milling prior to running the deflecting junction, but no separate deflector run is required. Additionally, the self-deflecting multilateral junction may be used with an open hole (OH) pressure tight L5 junction with high side exit, wherein the second lateral wellbore and the first wellbore are connected through a pressure tight "TAML level 5" Junction, in one single run, without the need of an additional run for the deflecting device, and furthermore no separate deflector run is required. Additionally, the self-deflecting multilateral junction may be used with an OH Pressure tight L5 junction with low side exit, wherein the second lateral wellbore and first wellbore are connected through a pressure tight "TAML level 5" Junction, in one single run, without the need of an additional run for the deflecting device, and furthermore no separate deflector run is required.

FIG. 1 illustrates a schematic view of a multilateral well system 100 according to one or more embodiments disclosed herein. The multilateral well 100 includes a wellhead 105 positioned over one or more oil and gas formations

110*a*, 110*b* located below the earth's surface 115. Although a land-based wellhead 105 is illustrated in FIG. 1, the scope of this disclosure is not thereby limited, and thus could potentially apply to offshore applications. The teachings of this disclosure may also be applied to other land-based oil and gas systems and/or offshore oil and gas systems different from that illustrated.

As shown, a main wellbore 120 has been drilled through the various earth strata, including the subterranean formations 110*a*, 110*b*. The term "first" wellbore is used herein to designate a wellbore from which another wellbore is drilled. It is to be noted, however, that a first wellbore 120 does not necessarily extend directly to the earth's surface, but could instead be a branch of yet another wellbore. Thus, the first wellbore 120 may be a first main wellbore, or a first lateral wellbore, and remain within the scope of the disclosure. The multilateral well 100 additionally includes one or more lateral wellbores 130*a*, 130*b* extending therefrom. The term "lateral" wellbore is used herein to designate a wellbore that is drilled outwardly from its intersection with another wellbore, such as the first wellbore 120. Moreover, a lateral wellbore may have another lateral wellbore drilled outwardly therefrom. While only two lateral wellbores 130*a*, 130*b* are illustrated in FIG. 1, certain embodiments may employ more than just two lateral wellbores. Furthermore, the lateral wellbore may be an open hole lateral wellbore, such as the lateral wellbore 130*a*, or may be a cased hole lateral wellbore, such as the lateral wellbore 130*b*.

One or more casing strings 140 may be at least partially cemented within the first wellbore 120, and optionally contained within the one or more lateral wellbores 130*a*, 130*b*. The term "casing" is used herein to designate a tubular string used to line a wellbore. Casing may be of the type known to those skilled in the art as "liner" and may be made of any material, such as steel or composite material and may be segmented or continuous, such as coiled tubing. A completion string 150 according to the present disclosure may be positioned in the first wellbore 120, for example above a junction between the first wellbore 120 and the uppermost lateral wellbore 130*a*.

The multilateral well 100 additionally includes one or more self-deflecting multilateral junctions 160 designed, manufactured and operated according to the disclosure. In at least one embodiment, the one or more self-deflection multilateral junctions 160 each include a deflection device having an uphole end and a downhole end, the deflection device including a main tubular, a first flow path for a first wellbore off the main tubular, a second flow path for a second lateral wellbore off the main tubular, the second flow path having a lateral seal bore, and a deflecting ramp. In at least one other embodiment, the one or more self-deflection multilateral junctions 160 each include a lateral stinger positioned within the main tubular and releasably coupled to the deflection device, the lateral stinger including a nose end, a valve member, and a lateral seal for engaging the lateral seal bore. Depending on whether the lateral stinger is deployed, or not, the nose end is either configured to extend into the second flow path, or already extending into the second flow path.

Figure 2:
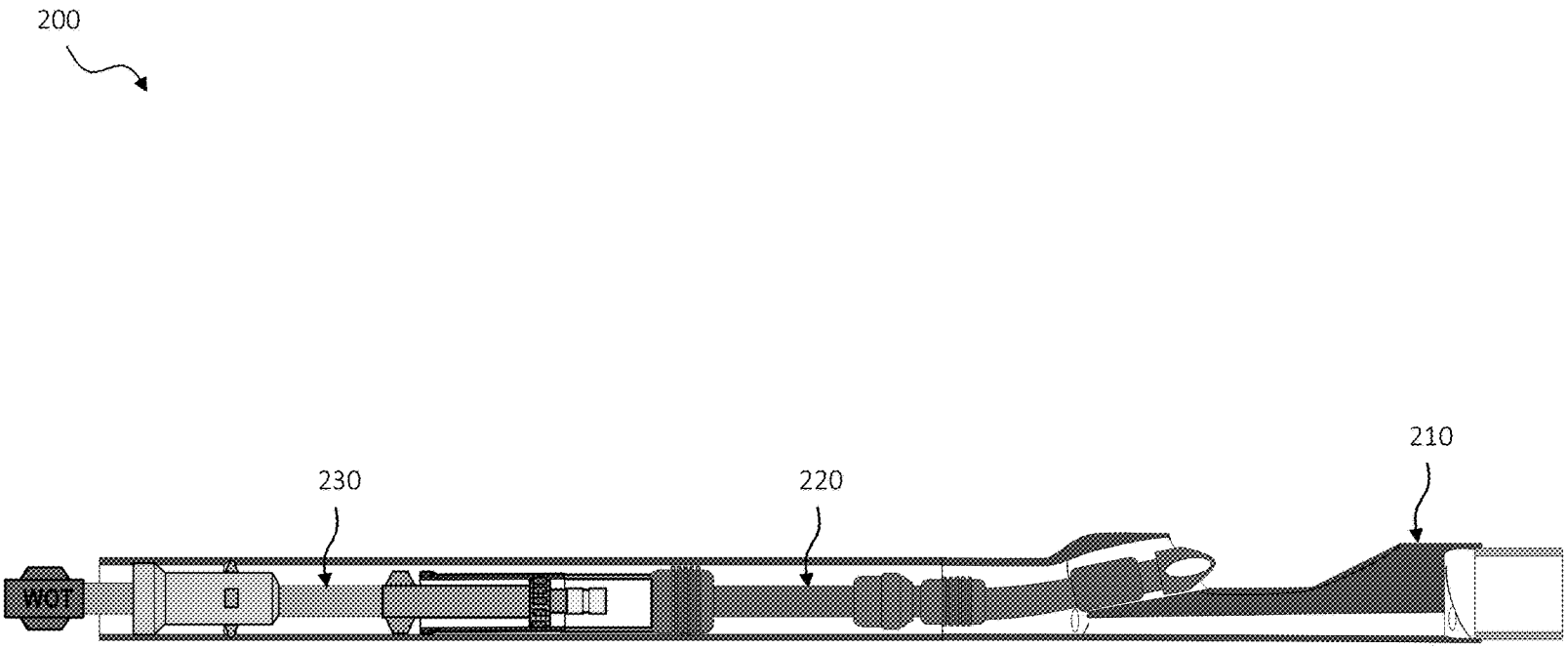
FIG. 2 illustrates a self-deflecting multilateral junction designed, manufactured, and operated according to the disclosure.

Turning to FIG. 2 illustrated is a self-deflecting multilateral junction 200 designed, manufactured, and operated according to the disclosure. The self-deflecting multilateral junction 200, in the illustrated embodiment, includes a deflection device 210. In at least the embodiment of FIG. 2, the self-deflecting multilateral junction 200 additionally includes a lateral stinger 220 positioned within the deflection device 210, the lateral stinger 220 releasably coupled to the deflection device 210. Further to the embodiment of FIG. 2, the self-deflecting multilateral junction 200 may additionally include a running tool 230 coupled to the lateral stinger 220. The self-deflecting multilateral junction 200, in the embodiment of FIG. 2, is illustrated in the run-in-hole configuration, and thus the deflection device 210, the lateral stinger 220 and the running tool 230 are still fixed relative to one another.

Figure 3:
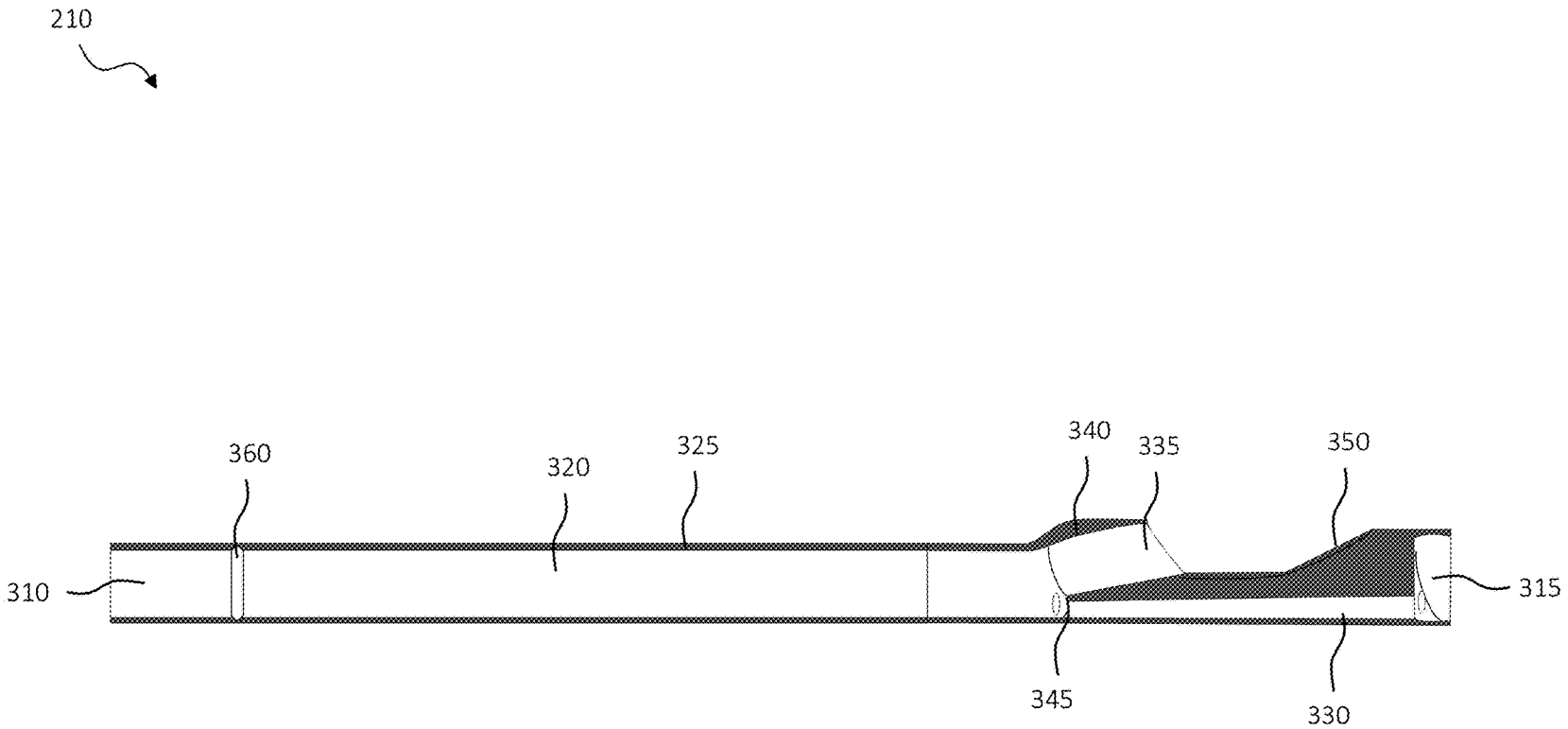
FIG. 3 illustrates one embodiment of the deflection device illustrated in FIG. 2.

Turning to FIG. 3, illustrated is one embodiment of the deflection device 210 illustrated in FIG. 2. The deflection device 210, in the illustrated embodiment, includes an uphole end 310 and a downhole end 315. The deflection device 210, in the illustrated embodiment, additionally includes a main tubular 320, a first flow path 330 off the main tubular 320 and operable to couple to a wellbore, and a second flow path 335 off the main tubular and operable to couple to a lateral wellbore. In at least one embodiment, such as that shown in FIG. 2, the main tubular 320 includes extension joints with a polished bore receptacle (PBR) 325. In at least one embodiment, such as that shown in FIG. 2, the second flow path 335 has a lateral seal bore 340 with a no go shoulder 345. The no-go shoulder 345, in at least one embodiment, is configured to engage with a sliding sleeve of a lateral stinger (e.g., lateral stinger 220 of FIG. 2) after the lateral stinger releases from the deflection device 210 and move a valve member of the lateral stinger from a closed position to an open position.

Further to the embodiment of FIG. 2, the deflection device 210 may additionally include a deflecting ramp 350 in one or more embodiments of the disclosure. Additionally, the deflection device 210 may include an inner profile 360 near the uphole end 310 thereof. In at least one embodiment, the inner profile 360 is configured to engage with a hydraulic locking tool of a running tool (e.g., the running tool 230 of FIG. 2), for example to releasably decouple a lateral stinger (e.g., the lateral stinger 220 of FIG. 2) from the deflection device 210.

Figure 4A:
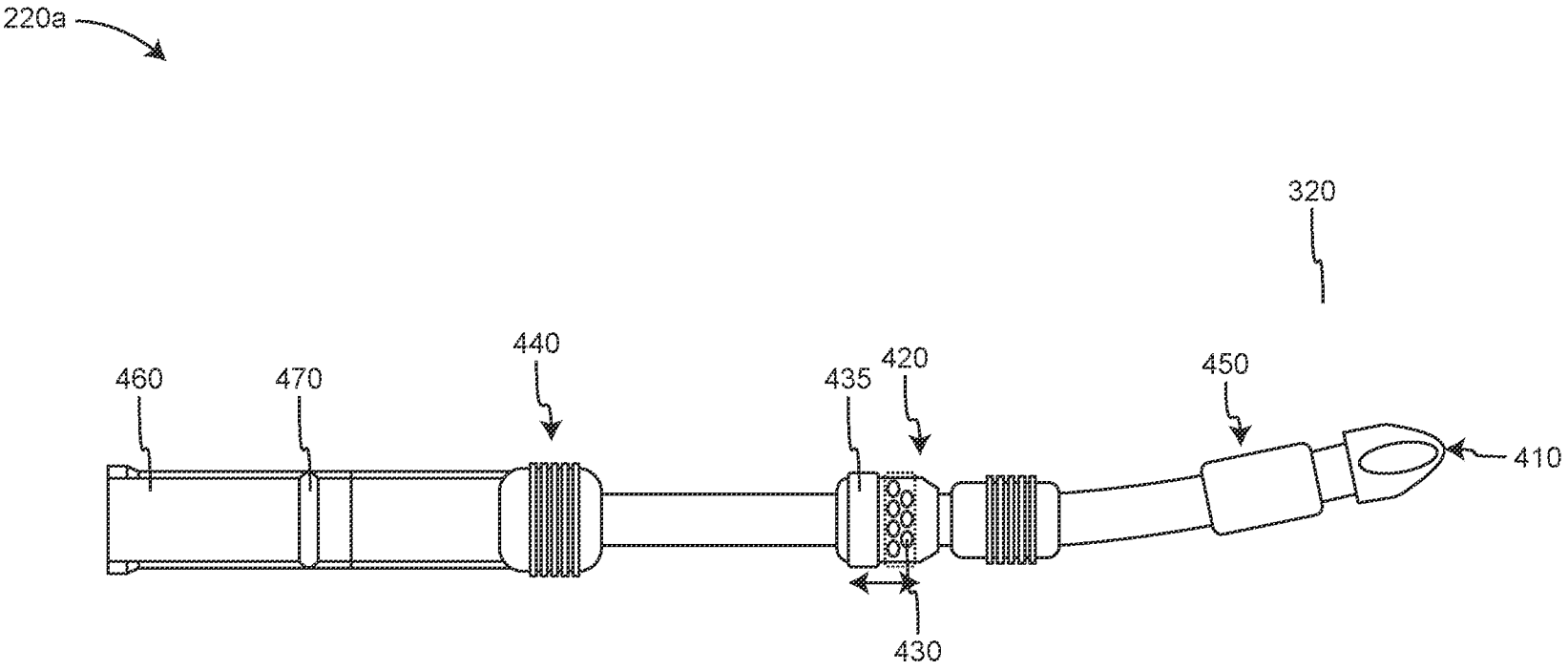
FIG. 4A illustrates one embodiment of a lateral stinger, which is similar to the lateral stinger illustrated in FIG. 2.

Turning to FIG. 4A, illustrated is one embodiment of a lateral stinger 220*a*, which is similar to the lateral stinger 220 illustrated in FIG. 2. The lateral stinger 220*a*, in the illustrated embodiment, includes a nose end 410 (e.g., bullnose end) configured to extend into a second flow path (e.g., second flow path 335 in FIG. 3). The lateral stinger 220*a*, in the illustrated embodiment, may additionally include a valve member 420. In at least one embodiment, the valve member 420 includes one or more ports 430 therein, as well as a sliding sleeve 435 configured to move from a closed position closing the valve member (e.g., closing the one or more ports) to an open position opening the valve member (e.g., opening the one or more ports). The sliding sleeve 435, in at least one embodiment, is a pinnable sliding sleeve 435, and furthermore has a profile configured to engage with one or more no-go shoulders (e.g., no-go shoulder 345 of FIG. 3) to move the sliding sleeve 435 from the closed position to the open position.

The lateral stinger 220*a*, in the illustrated embodiment, additionally includes a lateral seal 430 for engaging a lateral seal bore (e.g., the lateral seal bore 340 in FIG. 3). The lateral stinger 220*a*, in the illustrated embodiment, additionally includes a main tubular seal 440 on an opposite side of the valve member 420 as the lateral seal 430. The main tubular seal 440, in at least one embodiment, is operable to engage with a PBR (e.g., the PBR 325 in FIG. 3) in a main tubular (e.g., the main tubular 320 in FIG. 3).

The lateral stinger 220*a*, in the illustrated embodiment, may additionally include a packing element 450 between the nose end 410 and the lateral seal 430. The packing element 450, in at least one embodiment, is a swell packer configured to engage and/or seal with a lateral wellbore completion. That lateral stringer 220*a*, in the illustrated embodiment, additionally includes a liner top 460, which in certain embodiments has an inner profile 470.

Figure 4B:
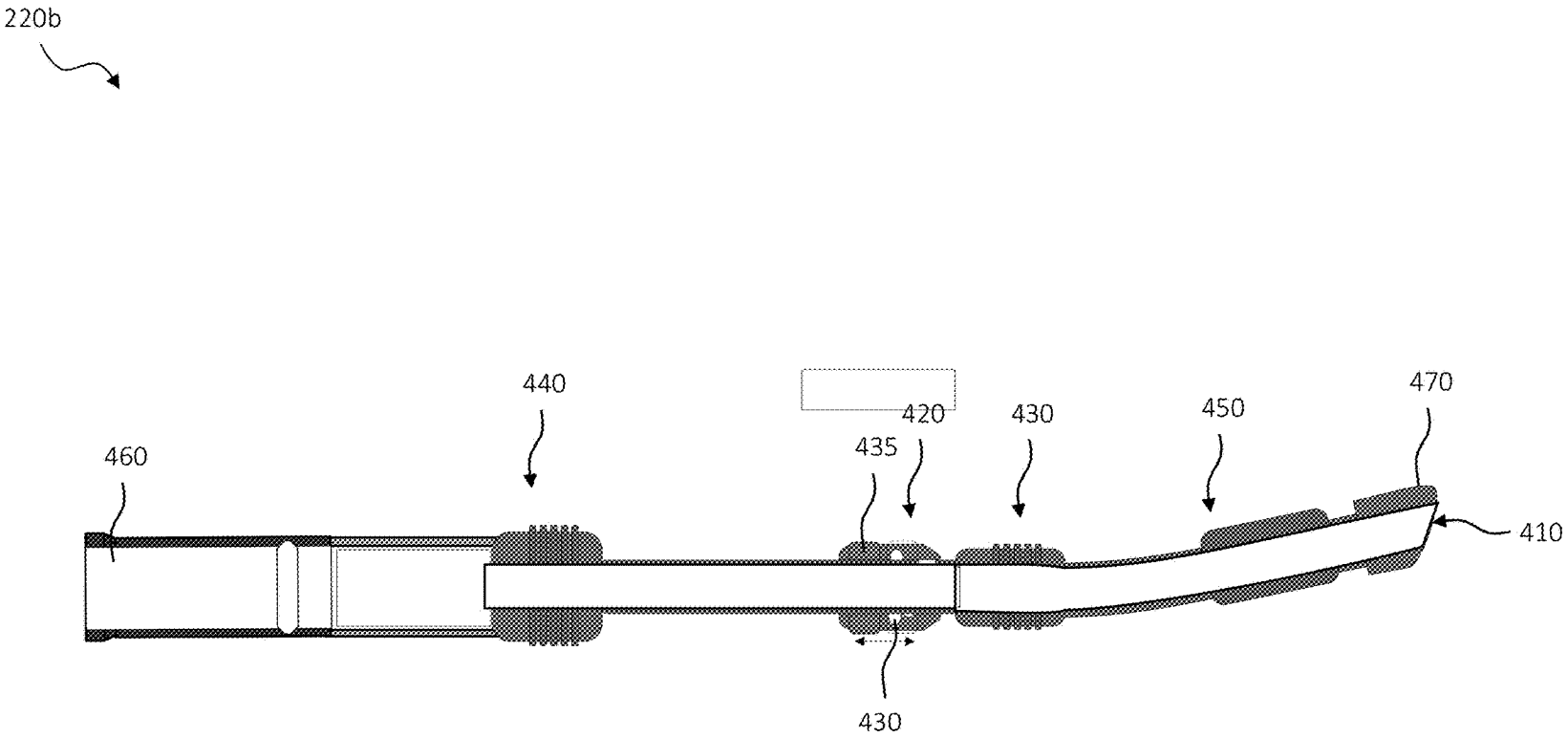
FIG. 4B illustrates an alternative embodiment of a lateral stinger, which is similar to the lateral stinger illustrated in FIG. 2.

Turning to FIG. 4B, illustrated is an alternative embodiment of a lateral stinger 220*b*, which is similar to the lateral stinger 220 illustrated in FIG. 2. The lateral stinger 220*b* and the lateral stinger 220*a* are similar in many respects, and thus similar reference numbers have been used to indicated similar, if not identical, features. The lateral stinger 220*b* differs, for the most part, form the lateral stinger 220*a*, in that the lateral stinger 220*b* includes a muleshoe 470 configured to allow an intervention tool to pass therethrough and access the lateral wellbore.

Figure 5:
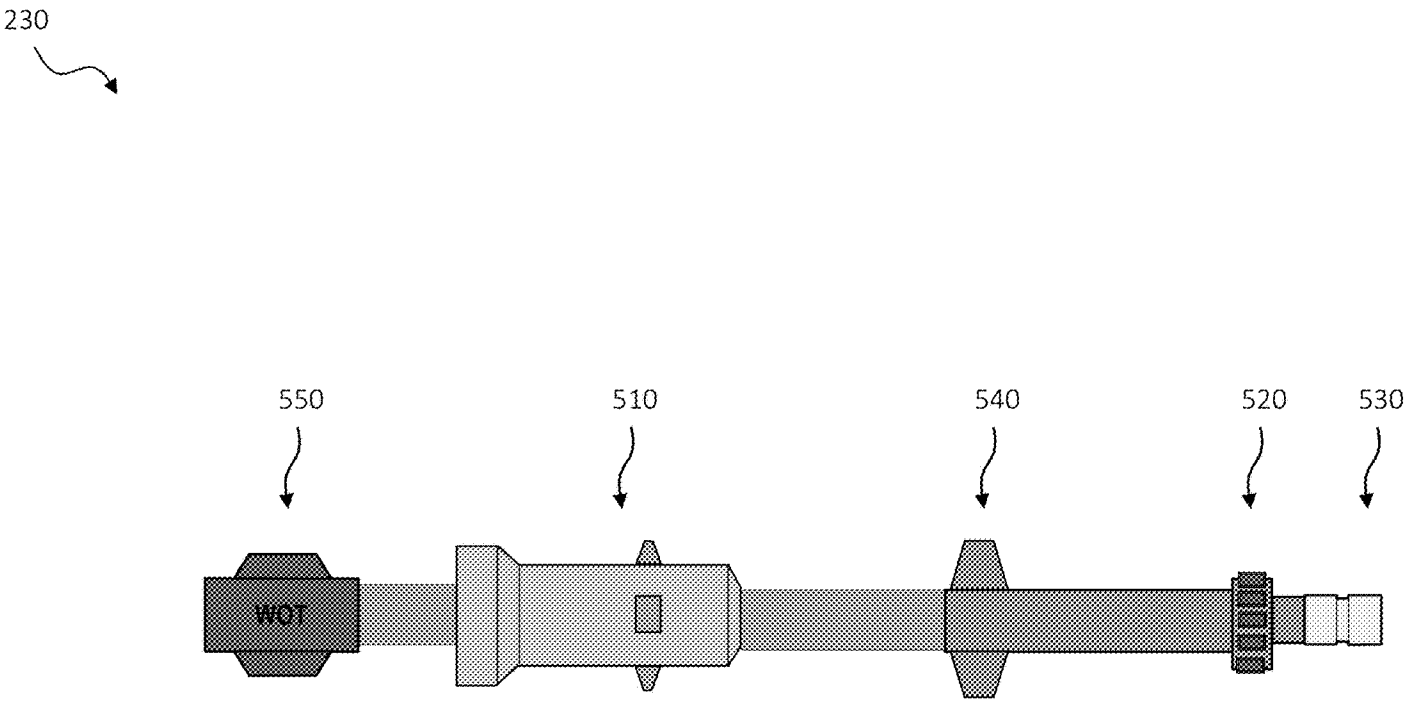
FIG. 5 illustrates one embodiment of the running tool illustrated in FIG. 2.

Turning to FIG. 5, illustrated is one embodiment of the running tool 230 illustrated in FIG. 2. The running tool 230, in the illustrated embodiment, includes a hydraulic locking tool 510 configured to engage with a profile (e.g., the profile 360 of FIG. 3) and releasably couple a lateral stinger (e.g., the lateral stinger 220 of FIG. 2) to a deflection device (e.g., the deflection device 210 of FIG. 2). The running tool 230, in one or more embodiments, additionally includes a second locking tool 520 configured to engage with a profile (e.g., profile 470 in FIG. 4A) in a lateral stinger (e.g., lateral stinger 220 of FIG. 2).

In at least one or more other embodiments, the running tool 230 additionally includes a circulation valve) 530. The circulation valve 530, in at least one embodiment, is configured to allow the running tool 230 to be pressured up upon, causing the hydraulic locking tool 510 or the second locking tool 520 to disengage with their respective profiles. The running tool 230, in the illustrated embodiment of FIG. 5 additionally includes one or more stabilizers 540, as well as a Workstring Orientation Tool (WOT) or measurement while drilling (MWD) tool 550.

Figure 6A:
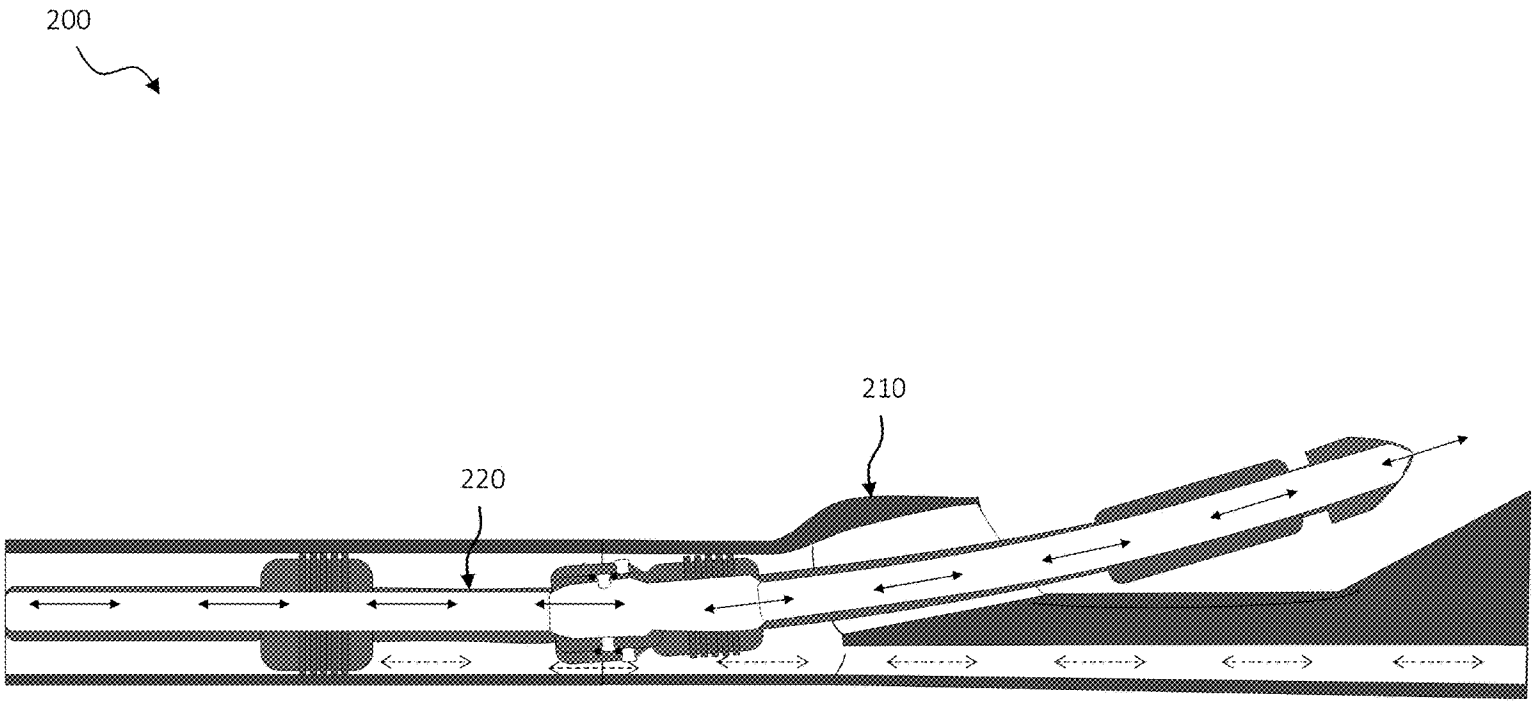
FIG. 6A illustrates the self-deflecting multilateral junction of FIG. 2 in an operational state wherein the lateral stinger is free to move downhole within the deflection device, but without the lateral stinger sealing against the lateral seal bore of the deflection device.

Turning to FIG. 6A, illustrated is the self-deflecting multilateral junction 200 of FIG. 2 in an operational state wherein the lateral stinger 220 is free to move downhole within the deflection device 210, but without the lateral stinger 220 sealing against the lateral seal bore of the deflection device 210. Accordingly, in the illustrated embodiment of FIG. 6A, the valve member of the lateral stinger 220 remains in the closed position, and thus no flow is possible from the first wellbore into the self-deflection multilateral junction 200.

Figure 6B:
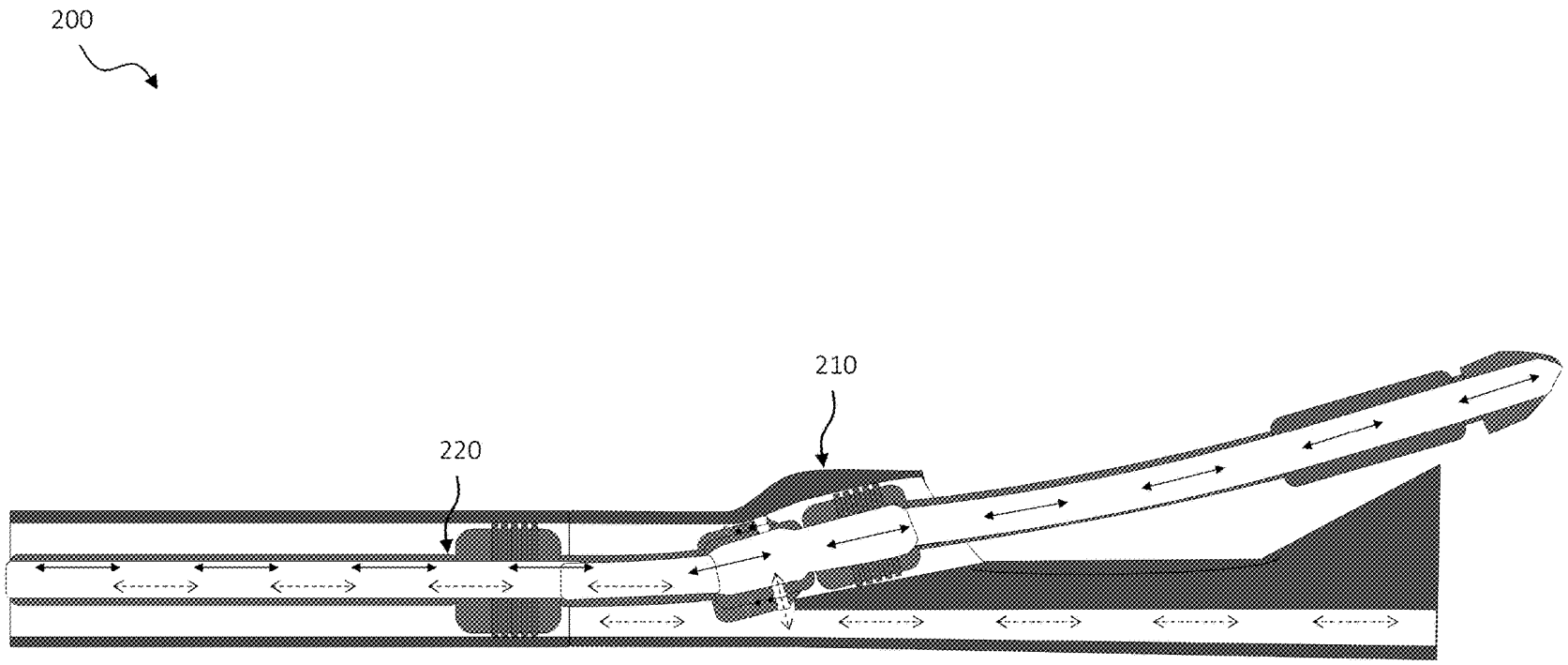
FIG. 6B illustrates the self-deflecting multilateral junction of FIG. 2 in an operational state wherein the lateral stinger seals against the lateral seal bore of the deflection device.

Turning to FIG. 6B, illustrated is the self-deflecting multilateral junction 200 of FIG. 2 in an operational state wherein the lateral stinger 220 seals against the lateral seal bore of the deflection device 210. Accordingly, in the illustrated embodiment of FIG. 6A, the sliding sleeve of the valve member has engaged with the no-go shoulder in the deflection device 210, thereby moving the valve member from the closed position to the open position, and thus flow is now possible from the first wellbore into the self-deflection multilateral junction 200.

Turning now to FIGS. 7 through 13, illustrated is one embodiment of a method for deploying a self-deflecting multilateral junction designed, manufactured, and operated according to one or more embodiments of the disclosure within a well system 700. The method begins in FIG. 7 by forming a wellbore 710 (e.g., first lateral wellbore, second lateral wellbore etc.) within a subterranean formation 705. As those skilled in the art appreciate, one or more drill bits 720 and/or MWD devices could be used to form the wellbore 710.

Figure 7:
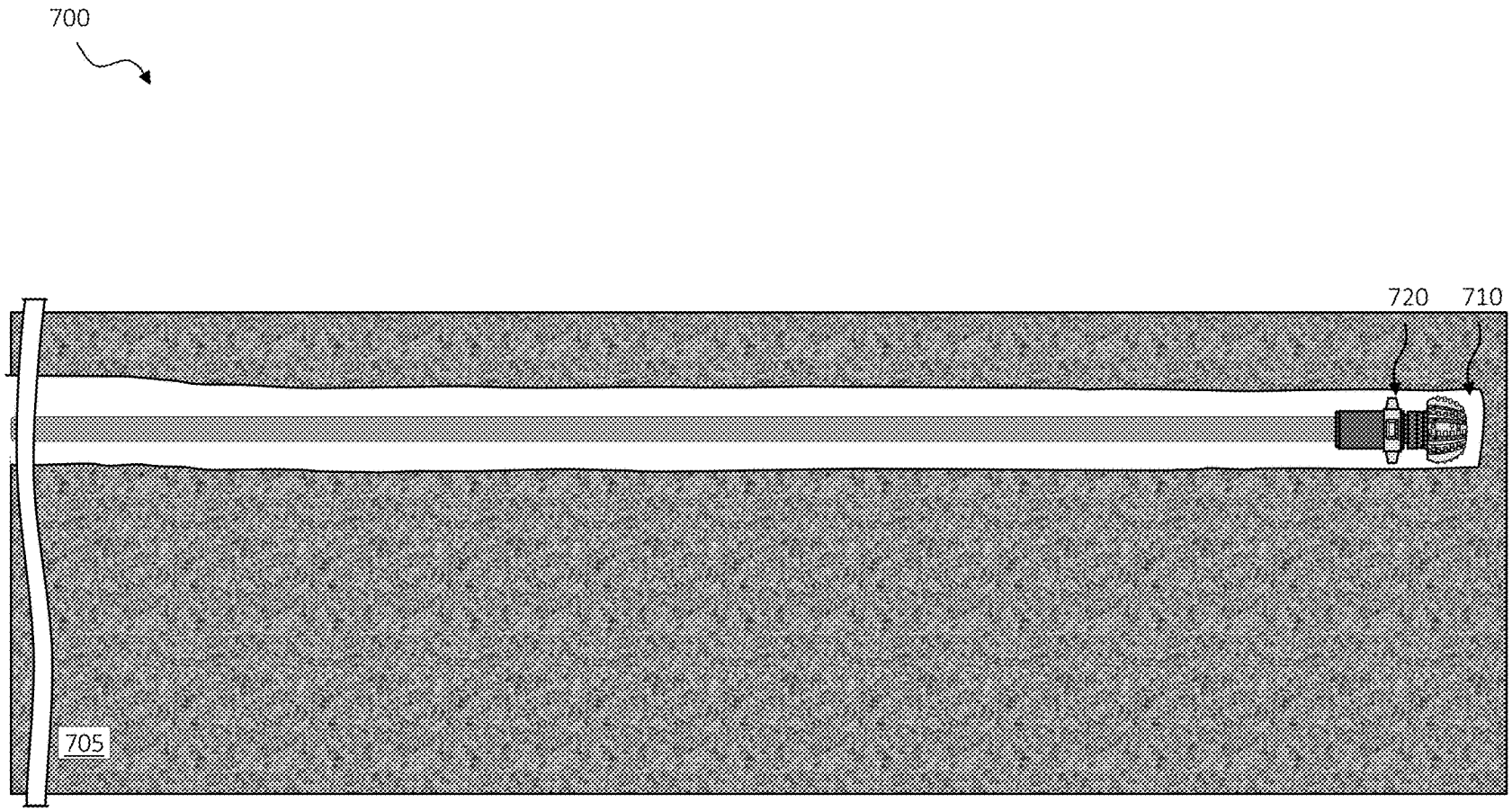
FIGS. 7 through 13 illustrate one embodiment of a method for deploying a self-deflecting multilateral junction designed, manufactured, and operated according to one or more embodiments of the disclosure within a well system.
Figure 8:
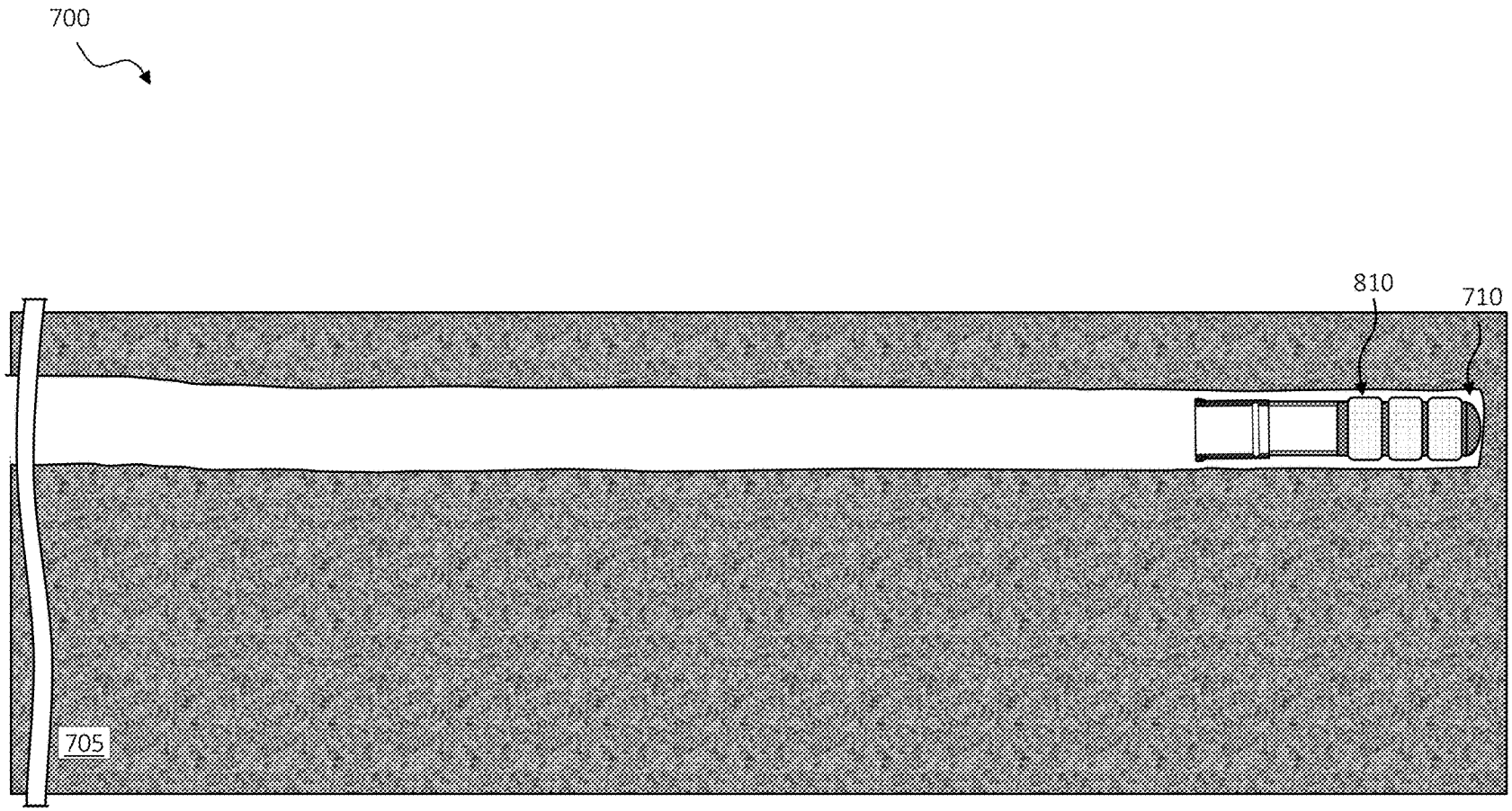

Turing to FIG. 8, illustrated is the well system 700 of FIG. 7 after deploying a wellbore completion 810 (e.g., lateral wellbore completion including one or more screen assemblies) within the wellbore 710 prior to performing a low-side exit and continuance of drilling the wellbore. Those skilled in the art understand and appreciate the steps necessary to deploy the wellbore completion 810.

Figure 9:
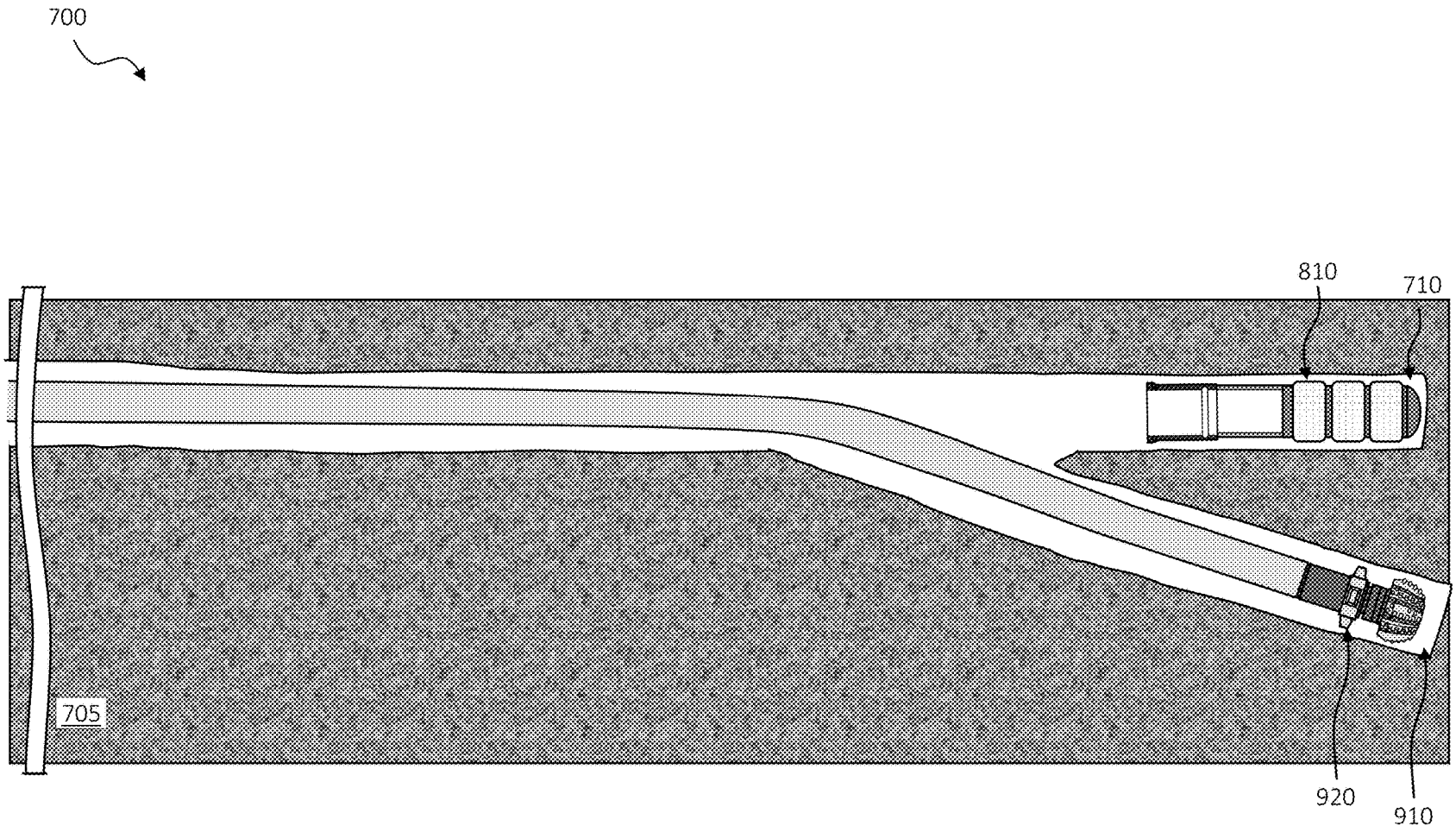

Turning to FIG. 9, illustrated is the well system 700 of FIG. 8 after continuing to form a wellbore 910 (e.g., main wellbore, first lateral wellbore, etc.). In the illustrated embodiment, the wellbore 910 is a main wellbore, and the wellbore 710 is a first lateral wellbore that extends from the main wellbore. In other embodiments, the wellbore 910 is a first lateral wellbore, and the wellbore 710 is a second lateral wellbore that extends from the first lateral wellbore. As those skilled in the art appreciate, one or more drill bits 920 and/or MWD devices could be used to form the wellbore 910. The wellbore 910, in the illustrated embodiment, is a low-side wellbore.

FIGS. 7 through 9 have been described as drilling the wellbore 710 first, and then drilling the wellbore 910 second. Nevertheless, other embodiments may exist wherein the wellbore 910 is drilled first, and the wellbore 710 is subsequently drilled off the wellbore 910. Accordingly, unless otherwise stated no order is implied and/or required.

Figure 10:
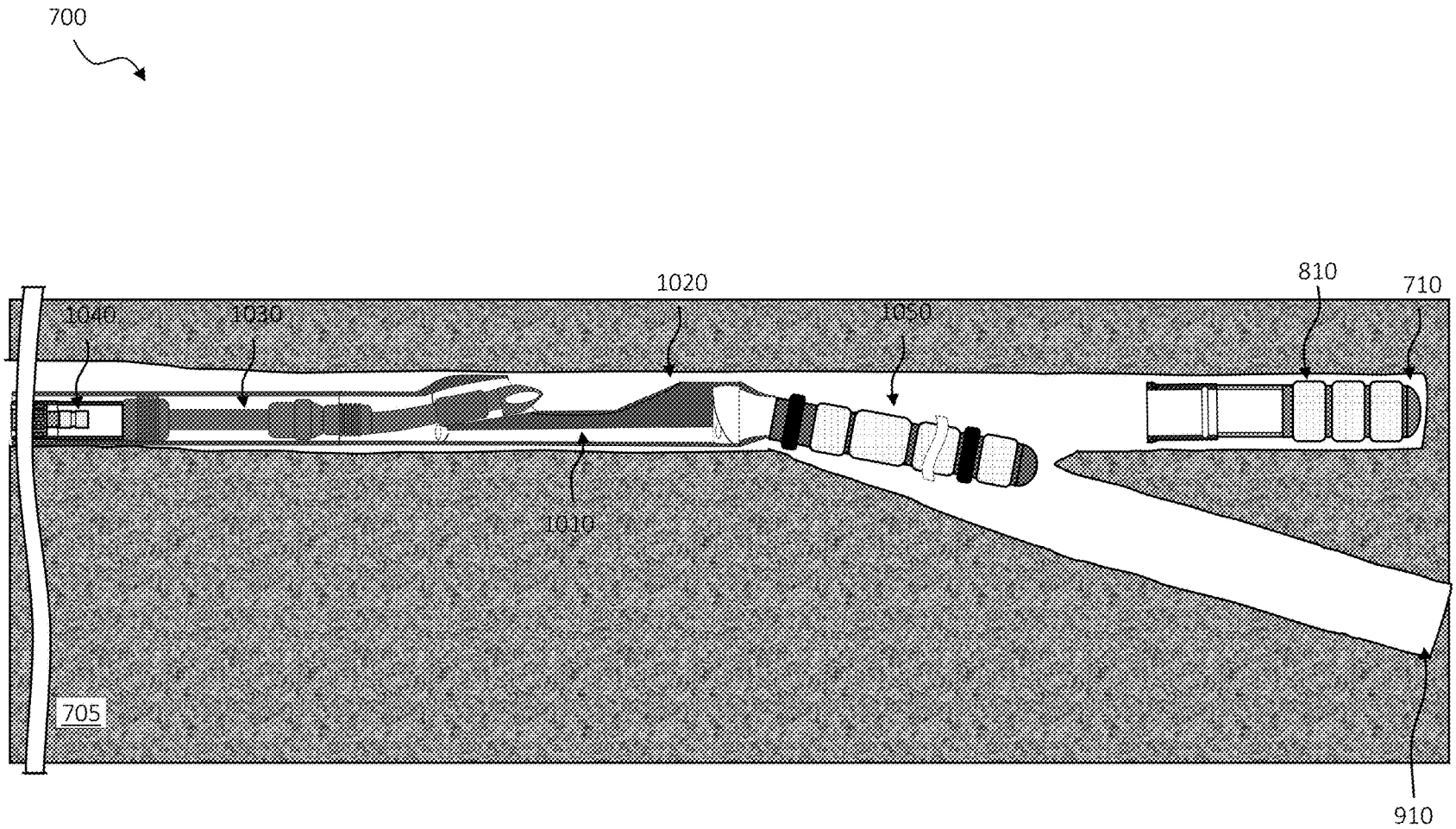

Turning to FIG. 10, illustrated is the well system 700 of FIG. 9 after positioning a self-deflecting multilateral junction 1010 downhole (e.g., within at least a portion of the wellbore 910). The self-deflecting multilateral junction 1010 may be similar in many respects to the self-deflecting multilateral junction 200 illustrated in FIG. 2. Accordingly, the self-deflecting multilateral junction 1010 may include a deflection device 1020, a lateral stinger 1030, and a running tool 1040. In the illustrated embodiment, the self-deflecting multilateral junction 1010 is in the run-in-hole operational state, and thus the lateral stinger 1030 is releasable coupled to the deflection device 1020.

In the illustrated embodiment of FIG. 10, the self-deflecting multilateral junction 1010 additionally includes a wellbore completion 1050 (e.g., main wellbore completion including one or more screen assemblies) coupled to a downhole end thereof. Thus, in the embodiment of FIG. 10, the wellbore completion 1050 is being run within the wellbore 910 using the self-deflecting multilateral junction 1010.

Figure 11:
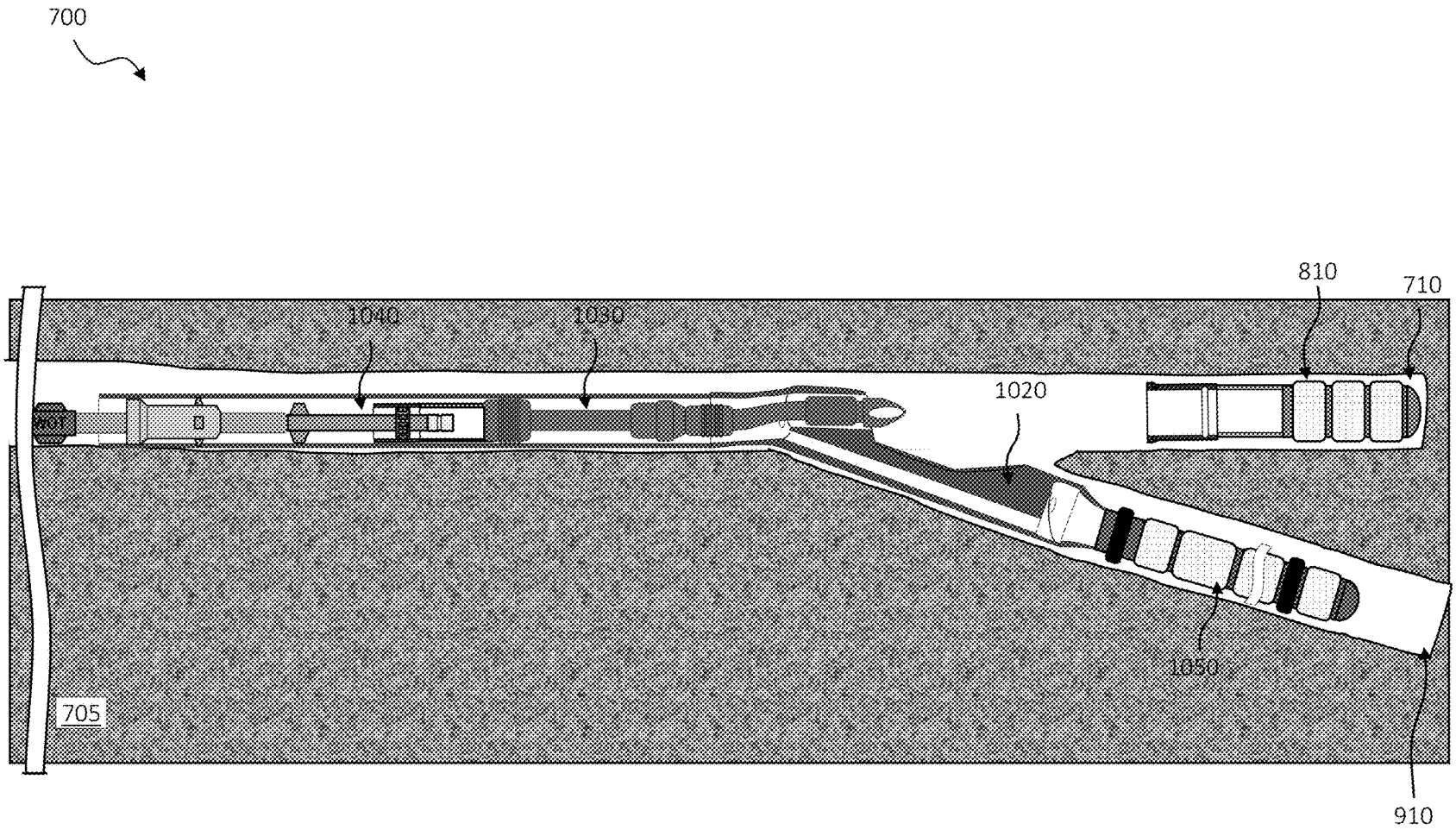

Turning to FIG. 11, illustrated is the well system 700 of FIG. 10 after positioning the self-deflecting multilateral junction 1010 at an intersection junction between the wellbore 710 and the wellbore 910. In doing so, the wellbore completion 1050 has been oriented and placed at a desired depth within the wellbore 910. The self-deflecting multilateral junction 1010 is still at its run-in-hole operational state, and thus its lateral stinger 1030 is still releasably coupled to its deflection device 1020.

Figure 12:
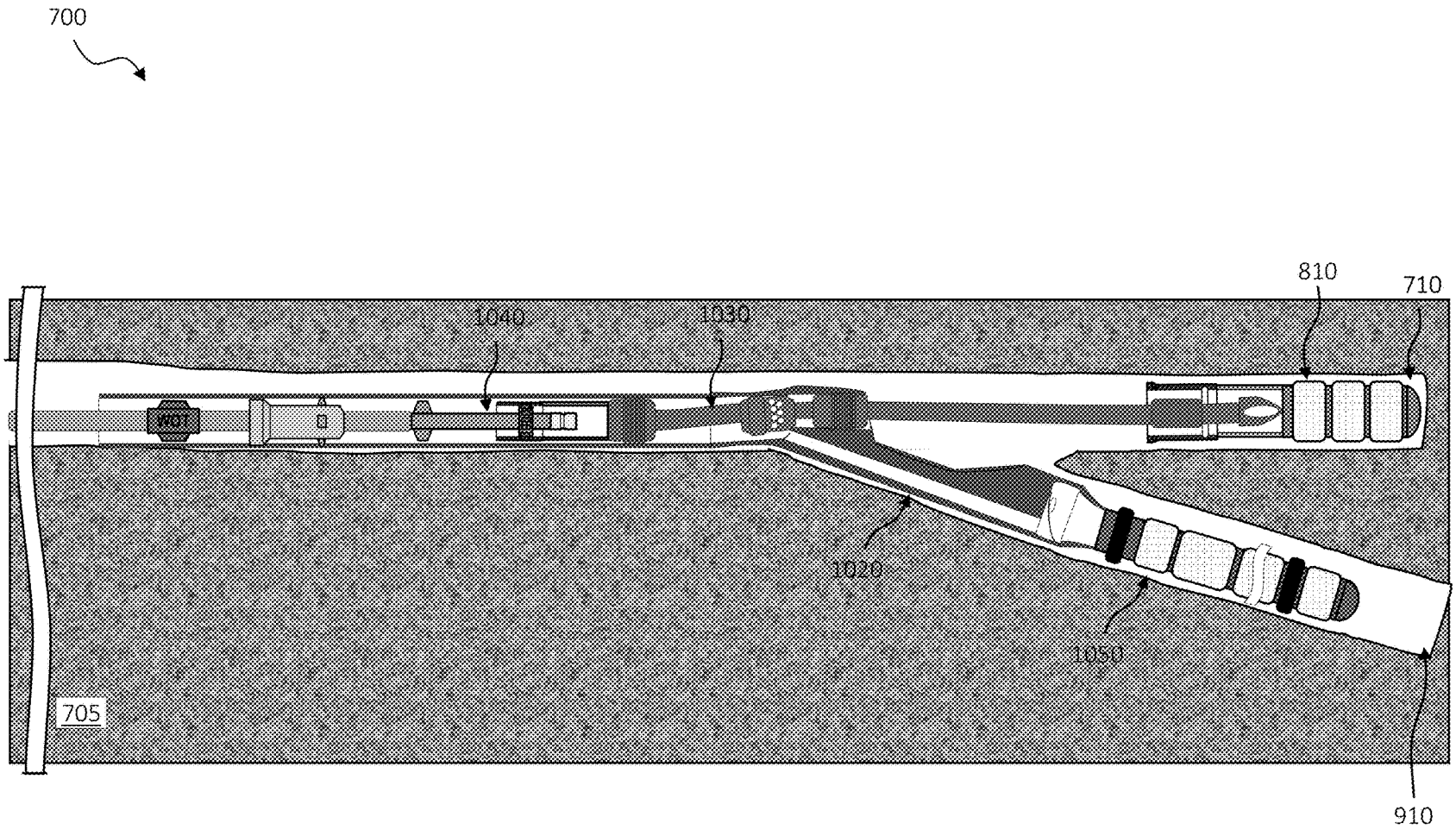

Turning to FIG. 12, illustrated is the well system 700 of FIG. 11 after decoupling the lateral stinger 1030 from the deflection device 1020. In at least one embodiment, the decoupling is achieved by pressuring down on the circulation valve of the running tool 1040 one or more times, and in doing so causing a hydraulic locking tool of the lateral stinger 1030 to disengage with a profile (e.g., the profile 360 of FIG. 3) in the main tubular of the deflection device 1020. With the hydraulic locking tool disengaged, the lateral stinger 1030 may be moved out through the lateral seal bore in the deflection device 1020 and into the lateral wellbore 710 (e.g., stinged into the wellbore completion 810 in the embodiment of FIG. 12). Furthermore, the lateral seal of the lateral stinger 1030 is appropriately positioned within the lateral seal bore of the deflection device 1020, and thus provides fluid isolation between the wellbore 710 and the wellbore 910. The main tubular seal of the lateral stinger 1030 also seals off an annulus between the main tubular of the deflection device 1020 and the lateral stinger 1030.

Additionally, in the embodiment of FIG. 12, the valve member of the lateral stinger 1030 includes a sliding sleeve configured to move from a closed position closing the valve member to an open position opening the valve member. Thus, as the lateral seal of the lateral stinger 1030 engages with the lateral seal bore of the deflection device 1020, the sliding sleeve engages a no-go shoulder of the deflection device 1020, thereby moving the valve member from the closed position to the open position.

Figure 13:
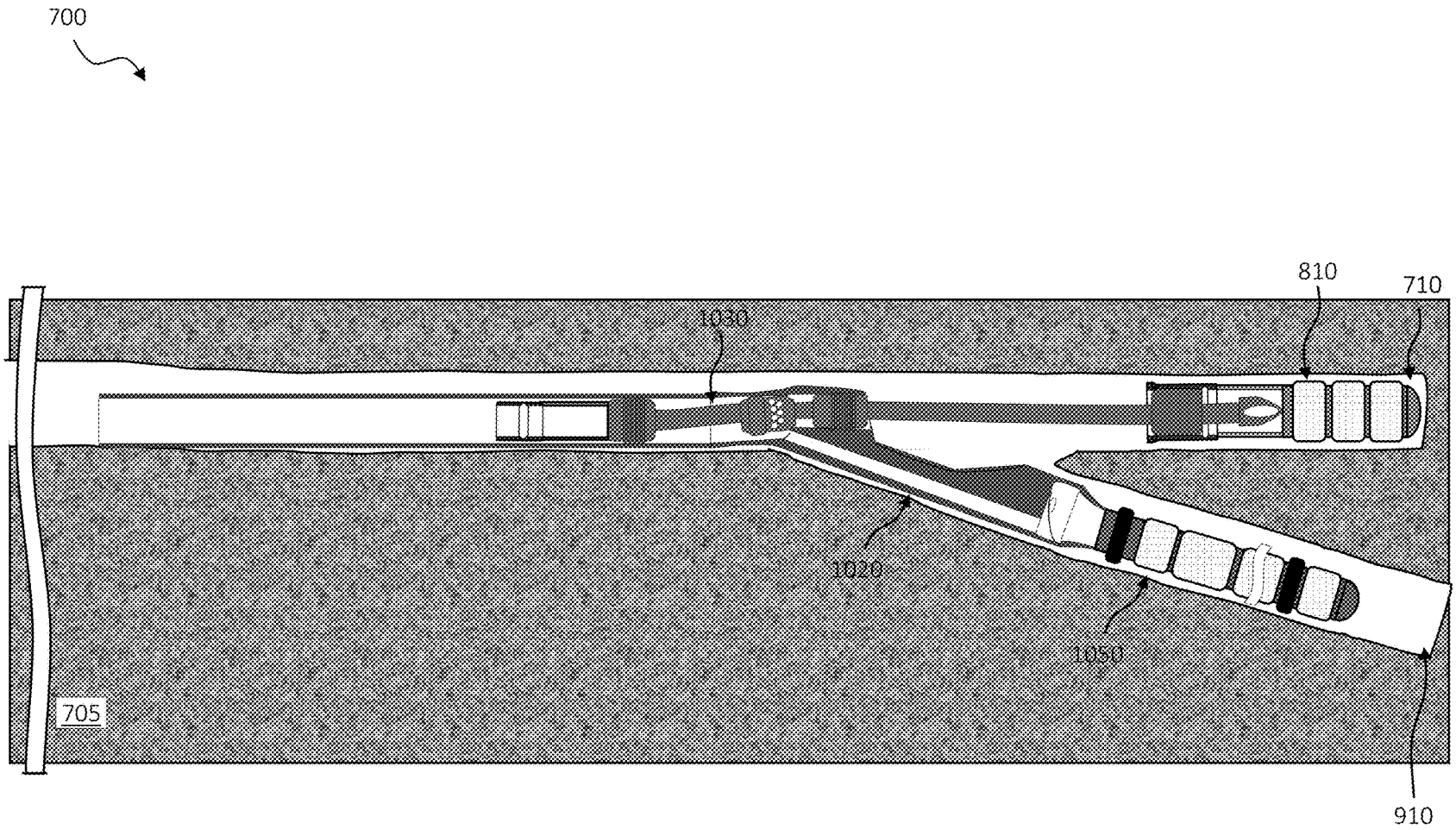

Turning to FIG. 13, illustrated is the well system 700 of FIG. 12 after disconnecting the running tool 1040 (not shown), thereby dropping off the lateral stinger 1030 for lateral completion. Additionally, the packing element (e.g., the swell packer 450 of FIG. 4A in one embodiment) of the lateral stinger 1030 may be set. At this stage, the seal is now engaged for lateral wellbore 710 and wellbore 910 production. In at least one embodiment, the step of positioning the self-deflecting multilateral junction (e.g., the steps shown in FIGS. 10 and 11), the step of decoupling the lateral stinger 1030 from the deflection device 1020 (e.g., the steps shown in FIG. 12), and the step of moving the decoupled lateral stinger 1030 out through the lateral seal bore in the deflection device 1020 and in the wellbore 910 (e.g., the steps shown in FIGS. 12 and 13), are all performed in a single run.

Figure 14:
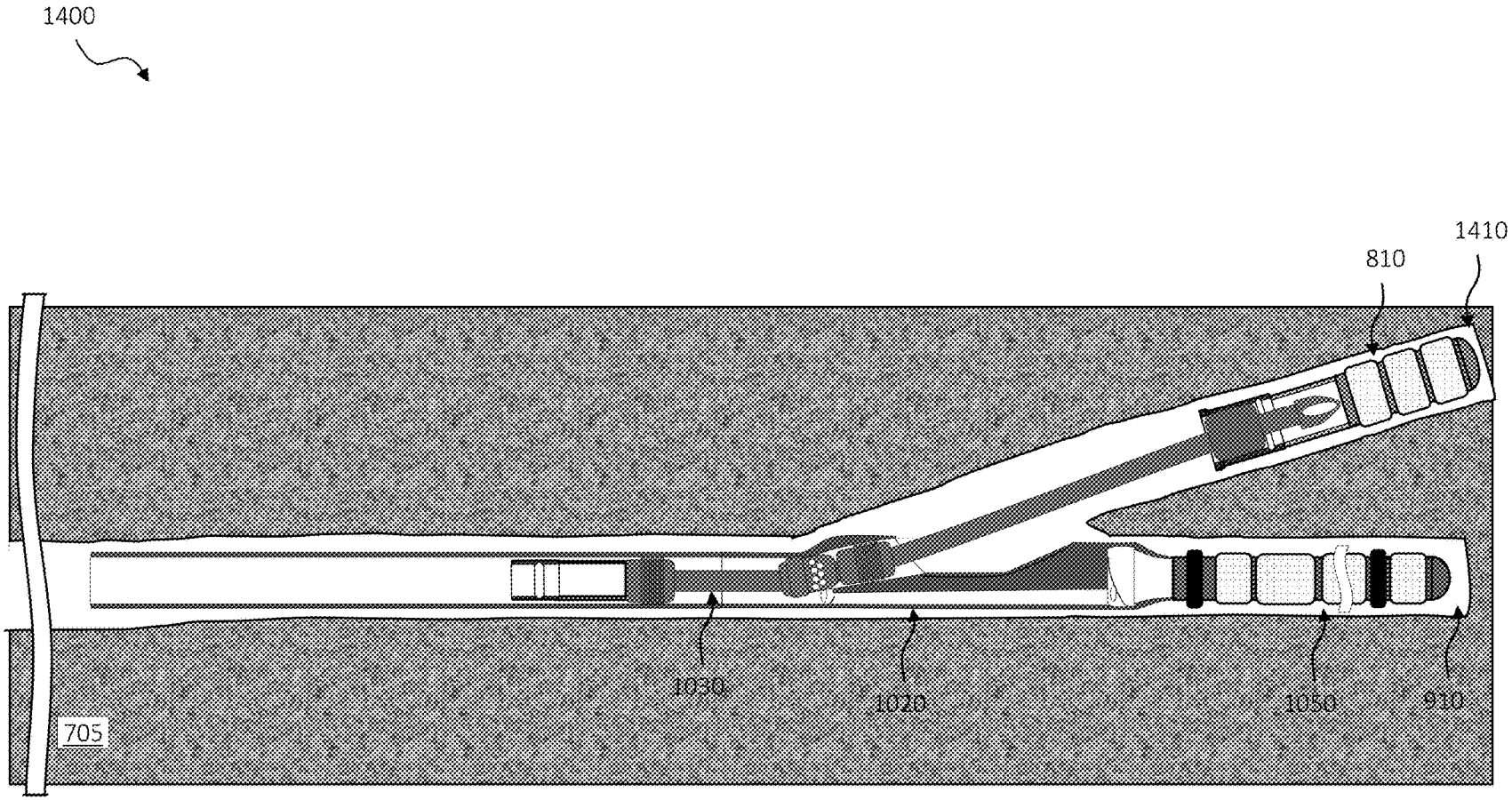
FIG. 14 illustrates an alternative embodiment of a well system designed, manufactured, and operated according to the disclosure.

Turning to FIG. 14, illustrated is an alternative embodiment of a well system 1400 designed, manufactured, and operated according to the disclosure. The well system 1400 is similar in many respects to the well system 700 discussed regarding FIGS. 7 through 13. Accordingly, like reference numbers have been used to indicated similar, if not identical, features. The well system 1400 differs, for the most part, from the well system 700, in that the well system 1400 employs a high side lateral wellbore 1410. Those skilled in the art understand that the high side lateral wellbore 1410 may require an additional whipstock run, for example if the well patch or formation requires.

Aspects disclosed herein include:

A. A self-deflecting multilateral junction, the self-deflecting multilateral junction including: 1) a deflection device having an uphole end and a downhole end, the deflection device including a main tubular, a first flow path off the main tubular and operable to couple to a wellbore, a second flow path off the main tubular and operable to couple to a lateral wellbore, the second flow path having a lateral seal bore, and a deflecting ramp; and 2) a lateral stinger positioned within the main tubular and releasably coupled to the deflection device, the lateral stinger including a nose end configured to extend into the second flow path, a valve member, and a lateral seal for engaging the lateral seal bore.

B. A method, the method including: 1) positioning a self-deflecting multilateral junction at an intersection junction between a wellbore and a lateral wellbore, the self-deflection multilateral junction including: a) a deflection device having an uphole end and a downhole end, the deflection device including a main tubular, a first flow path coupled to the wellbore, a second flow path coupled to the lateral wellbore, the second flow path having a lateral seal bore, and a deflecting ramp; and b) a lateral stinger positioned within the main tubular and releasably coupled to the deflection device, the lateral stinger including a nose end configured to extend into the second flow path, a valve member, and a lateral seal for engaging the lateral seal bore; 2) decoupling the lateral stinger from the deflection device once the self-deflecting multilateral junction is positioned; and 3) moving the decoupled lateral stinger out through the lateral seal bore and into the lateral wellbore.

C. A well system, the well system including: 1) a wellbore extending into a subterranean formation; 2) a lateral wellbore extending from the wellbore; and 3) a self-deflecting multilateral junction positioned at an intersection between the wellbore and the lateral wellbore, the self-deflection multilateral junction including: a) a deflection device having an uphole end and a downhole end, the deflection device including a main tubular, a first flow path off the main tubular and coupled to the wellbore, a second flow path off the main tubular and coupled to the lateral wellbore, the second flow path having a lateral seal bore, and a deflecting ramp; and b) a lateral stinger positioned within the main tubular and releasably coupled to the deflection device, the lateral stinger including a nose end configured to extend into the second flow path, a valve member, and a lateral seal for engaging the lateral seal bore.

Aspects A, B, and C may have one or more of the following additional elements in combination: Element 1: wherein the lateral stinger further includes a main tubular seal on an opposite side of the valve member as the lateral seal. Element 2: wherein the lateral stinger further includes a packing element between the nose end and the lateral seal. Element 3: wherein the valve member includes a sliding sleeve configured to move from a closed position closing the valve member to an open position opening the valve member. Element 4: wherein the deflection device has a no-go shoulder configured to engage with the sliding sleeve after the lateral stinger releases from the deflection device and move the valve member from the closed position to the open position. Element 5: wherein a wellbore completion is coupled to the downhole end. Element 6: further including a running tool coupled to the lateral stinger, the running tool including a hydraulic locking tool. Element 7: wherein the main tubular has a profile for engaging with the hydraulic locking tool to releasably decouple the lateral stinger from the deflection device. Element 8: wherein the lateral stinger includes a muleshoe configured to allow an intervention tool to pass therethrough and access the lateral wellbore. Element 9: wherein moving the lateral stinger out through the lateral seal bore and into the lateral wellbore includes positioning the lateral seal within the lateral seal bore. Element 10: wherein the lateral wellbore includes a lateral wellbore completion therein, and further wherein positioning the lateral seal within the lateral seal bore includes stabbing the nose end of the lateral stinger into the lateral wellbore completion. Element 11: wherein the lateral stinger further includes a packing element between the nose end and the lateral seal, and further wherein stabbing the nose end of the lateral stinger into the lateral wellbore completion includes setting the packing element in the lateral wellbore completion. Element 12: wherein the lateral stinger further includes a main tubular seal on an opposite side of the valve member as the lateral seal, and further wherein the main tubular seal seals an annulus between the main tubular and the lateral stinger. Element 13: wherein the valve member includes a sliding sleeve configured to move from a closed position closing the valve member to an open position opening the valve member and the deflection device has a no-go shoulder configured to engage with the sliding sleeve when the lateral stinger releases from the deflection device, and further wherein positioning the lateral seal within the lateral seal bore includes pushing the sliding sleeve against the no-go shoulder to move the valve member from the closed position to the open position. Element 14: further including a running tool coupled to the lateral stinger, the running tool including a hydraulic locking tool. Element 15: wherein the main tubular has a profile for engaging with the hydraulic locking tool to releasably couple the lateral stinger from the deflection device. Element 16: wherein decoupling the lateral stinger from the deflection device includes pressuring up the hydraulic locking tool to decouple the lateral stinger from the deflection device. Element 17: wherein the lateral stinger includes a muleshoe configured to allow an intervention tool to pass therethrough and access the lateral wellbore, and further including accessing the lateral wellbore with the intervention tool through the muleshoe. Element 18: wherein a wellbore completion is coupled to the downhole end of the deflection device, and further wherein positioning the self-deflecting multilateral junction at the intersection between the wellbore and the lateral wellbore includes placing the wellbore completion in the wellbore. Element 19: wherein the positioning, the decoupling, and the moving occur in a single run.

Those skilled in the art to which this application relates will appreciate that other and further additions, deletions, substitutions and/or modifications may be made to the described embodiments.

What is claimed is:

1. A self-deflecting multilateral junction, comprising:

a deflection device having an uphole end and a downhole end, the deflection device including a main tubular, a first flow path off the main tubular and operable to couple to a wellbore, a second flow path off the main tubular and operable to couple to a lateral wellbore, the second flow path having a lateral seal bore, and a deflecting ramp; and a lateral stinger positioned within the main tubular and releasably coupled to the deflection device, the lateral stinger including a nose end configured to extend into the second flow path, a valve member, and a lateral seal for engaging the lateral seal bore, wherein the valve member includes a sliding sleeve configured to move from a closed position closing the valve member to an open position opening the valve member.

2. The self-deflecting multilateral junction as recited in claim 1, wherein the lateral stinger further includes a main tubular seal on an opposite side of the valve member as the lateral seal.

3. The self-deflecting multilateral junction as recited in claim 1, wherein the lateral stinger further includes a packing element between the nose end and the lateral seal.

4. The self-deflecting multilateral junction as recited in claim claim 1, wherein the deflection device has a no-go shoulder configured to engage with the sliding sleeve after the lateral stinger releases from the deflection device and move the valve member from the closed position to the open position.

5. The self-deflecting multilateral junction as recited in claim 1, wherein a wellbore completion is coupled to the downhole end.

6. The self-deflecting multilateral junction as recited in claim 1, further including a running tool coupled to the lateral stinger, the running tool including a hydraulic locking tool.

7. The self-deflecting multilateral junction as recited in claim 6, wherein the main tubular has a profile for engaging with the hydraulic locking tool to releasably decouple the lateral stinger from the deflection device.

8. The self-deflecting multilateral junction as recited in claim 1, wherein the lateral stinger includes a muleshoe configured to allow an intervention tool to pass therethrough and access the lateral wellbore.

9. A method, comprising:

positioning a self-deflecting multilateral junction at an intersection junction between a wellbore and a lateral wellbore, the self-deflection multilateral junction including:

a deflection device having an uphole end and a downhole end, the deflection device including a main tubular, a first flow path coupled to the wellbore, a second flow path coupled to the lateral wellbore, the second flow path having a lateral seal bore, and a deflecting ramp; and a lateral stinger positioned within the main tubular and releasably coupled to the deflection device, the lateral stinger including a nose end configured to extend into the second flow path, a valve member, and a lateral seal for engaging the lateral seal bore, wherein the valve member includes a sliding sleeve configured to move from a closed position closing the valve member to an open position opening the valve member;

decoupling the lateral stinger from the deflection device once the self-deflecting multilateral junction is positioned; and moving the decoupled lateral stinger out through the lateral seal bore and into the lateral wellbore.

10. The method as recited in claim 9, wherein moving the lateral stinger out through the lateral seal bore and into the lateral wellbore includes positioning the lateral seal within the lateral seal bore.

11. The method as recited in claim 10, wherein the lateral wellbore includes a lateral wellbore completion therein, and further wherein positioning the lateral seal within the lateral seal bore includes stabbing the nose end of the lateral stinger into the lateral wellbore completion.

12. The method as recited in claim 11, wherein the lateral stinger further includes a packing element between the nose end and the lateral seal, and further wherein stabbing the nose end of the lateral stinger into the lateral wellbore completion includes setting the packing element in the lateral wellbore completion.

13. The method as recited in claim 9, wherein the lateral stinger further includes a main tubular seal on an opposite side of the valve member as the lateral seal, and further wherein the main tubular seal seals an annulus between the main tubular and the lateral stinger.

14. The method as recited in claim 9, wherein the deflection device has a no-go shoulder configured to engage with the sliding sleeve when the lateral stinger releases from the deflection device, and further wherein positioning the lateral seal within the lateral seal bore includes pushing the sliding sleeve against the no-go shoulder to move the valve member from the closed position to the open position.

15. The method as recited in claim 9, further including a running tool coupled to the lateral stinger, the running tool including a hydraulic locking tool.

16. The method as recited in claim 15, wherein the main tubular has a profile for engaging with the hydraulic locking tool to releasably couple the lateral stinger from the deflection device.

17. The method as recited in claim 16, wherein decoupling the lateral stinger from the deflection device includes pressuring up the hydraulic locking tool to decouple the lateral stinger from the deflection device.

18. The method as recited in claim 9, wherein the lateral stinger includes a muleshoe configured to allow an intervention tool to pass therethrough and access the lateral wellbore, and further including accessing the lateral wellbore with the intervention tool through the muleshoe.

19. The method as recited in claim 9, wherein a wellbore completion is coupled to the downhole end of the deflection device, and further wherein positioning the self-deflecting multilateral junction at the intersection between the wellbore and the lateral wellbore includes placing the wellbore completion in the wellbore.

20. The method as recited in claim 9, wherein the positioning, the decoupling, and the moving occur in a single run.

21. A well system, comprising:

a wellbore extending into a subterranean formation;

a lateral wellbore extending from the wellbore; and a self-deflecting multilateral junction positioned at an intersection between the wellbore and the lateral wellbore, the self-deflection multilateral junction including:

a deflection device having an uphole end and a downhole end, the deflection device including a main tubular, a first flow path off the main tubular and coupled to the wellbore, a second flow path off the main tubular and coupled to the lateral wellbore, the second flow path having a lateral seal bore, and a deflecting ramp; and a lateral stinger positioned within the main tubular and releasably coupled to the deflection device, the lateral stinger including a nose end configured to extend into the second flow path, a valve member, and a lateral seal for engaging the lateral seal bore, wherein the valve member includes a sliding sleeve configured to move from a closed position closing the valve member to an open position opening the valve member.

* * * * *